US006006945A

United States Patent [19]

Kirkland

[11] Patent Number: 6,006,945

[45] Date of Patent: Dec. 28, 1999

[54] VENDABLE CONTAINER

[76] Inventor: Mark R. Kirkland, 549 E. Cobblestone Dr., Midvale, Utah 84047

[21] Appl. No.: 08/173,560

[22] Filed: Dec. 22, 1993

[51] Int. Cl.[6] ..... G07F 7/00

[52] U.S. Cl. ..... 221/1; 53/467; 221/129; 221/195; 221/312 C; 229/4.5

[58] Field of Search ..... 221/1, 129, 131, 221/133, 194, 195, 312 C; D20/1, 4, 5; 53/467, 471; 229/4.5

[56] References Cited

U.S. PATENT DOCUMENTS

| | | | |
|---|---|---|---|
| D. 315,714 | 3/1991 | Ficken . | |
| 2,901,118 | 8/1959 | Beesley | D20/1 |
| 3,043,474 | 7/1962 | Mullin | 221/195 |
| 3,498,798 | 3/1970 | Baur et al. | 53/471 |
| 4,077,538 | 3/1978 | Waterbury . | |
| 4,127,212 | 11/1978 | Waterbury . | |
| 4,164,303 | 8/1979 | Waterbury . | |
| 4,170,724 | 10/1979 | Waterbury . | |
| 4,192,436 | 3/1980 | Schuller et al. | 221/129 |
| 4,252,250 | 2/1981 | Toth | 221/195 |
| 4,405,059 | 9/1983 | Kull | 221/129 |
| 4,766,019 | 8/1988 | Michaels et al. . | |
| 4,967,538 | 11/1990 | Leftault, Jr. et al. | 53/471 |
| 4,986,441 | 1/1991 | Kanbe et al. | 221/131 |
| 5,046,639 | 9/1991 | Deberry | 221/131 |
| 5,080,256 | 1/1992 | Rockda | 221/131 |
| 5,176,287 | 1/1993 | Suris | 221/131 |
| 5,176,288 | 1/1993 | Craven | 221/129 |
| 5,199,598 | 4/1993 | Sampson | 221/194 |

FOREIGN PATENT DOCUMENTS

| | | | |
|---|---|---|---|
| 1000605 | 8/1965 | United Kingdom | 221/129 |

OTHER PUBLICATIONS

"Vend", p. 20, Jun. 1971, D20/4 (Advertisement).
"Vend" Advertisement, p. 50, Feb. 1963, D20/5.

*Primary Examiner*—Gary E. Elkins
*Attorney, Agent, or Firm*—Morriss, Bateman, O'Bryant & Compagni

[57] ABSTRACT

A container structure for solid retaining foods, such as cookies and snack chips, or non-food items, such as first aid products or golf balls, is disclosed which is sized and configured to be vendable from a vending machine which is configured for dispensing canned drinks. The container structure and method of vending disclosed presents advantages in the art in providing both vendable food and non-food items with beverages from a single vending machine, facilitates restocking of such vending machines, and provides a more readily recyclable container for vendable foods and non-food items.

7 Claims, 2 Drawing Sheets

VENDABLE CONTAINER

BACKGROUND OF THE INVENTION

1. Field of the Invention

This application relates to packaging for food and non-food items which are sized for being dispensed from vending machines.

2. State of the Art

Various types of coin-operated vending machines are known for dispensing beverage and food products. A very common type is that which dispenses soft drinks, usually cold, in standard 12 oz. cans. In a typical such machine, rows of cans are held in a refrigerated internal storage area and chute means may be positioned to move the cans to a delivery slot. When the machine is activated, such as by insertion of coinage or other form of payment, a can is released from the storage area and delivered through a chute means to the delivery slot. The chute is shaped and sized so that the can may slide or roll in an orderly way to the delivery area for grasping by the purchaser.

Vending machines for other kinds of foods such as cookies, sandwiches, candy bars, fruit, snack chips, crackers, hard-boiled eggs, and the like, are typically somewhat different than soft-drink machines. One kind of machine has coiled wires holding the goods, the packaging of which must be of relatively flat configuration suitable for holding between adjacent coils of the wire. Activation of the machine for a selected item causes the wire coil holding that item to rotate about its central axis, causing the item to move forward to the end of the coil and then to drop free to a slot where it is graspable by the purchaser. Another kind of machine has a series of flat-bottomed compartments arranged in columns on an inner housing which rotates in steps about a vertical axis. Each step brings one column of compartments in registration with doors in an outer housing, a door being openable upon payment by the purchaser.

The described types of food vending machines (as distinguished from soda can dispensing machines) are suitable for their intended purposes, but have certain disadvantages. Both kinds of machines have relatively limited capacity, and each individual item must be restocked by hand, coil-by-coil or compartment-by-compartment. The restocking process is thus time-consuming and tedious. In contrast, restocking of a soft-drink machine of the type described above is simpler and less time-consuming, since all that is needed is to place an oriented group of cans into the refrigerated holding area. The round cans tend to orient themselves in groups.

Also, the types of machines that dispense solid foods are generally much less widely distributed than are soft-drink can dispensing machines. Thus, soft drink vending machines are very prevalent, even in remote or sparsely travelled areas. As a result, a vending machine location may provide only soft drinks, or may provide only vendable food, but typically not both.

Coil-type machines are not suitable for dispensing drinks, whether in cans or otherwise. In general, the compartments of automat-style machines are not sized large enough for dispensing standard soft drink cans, though they may dispense drinks in smaller sized cans (for example six ounce juice cans). Still another problem with the coil-type machines is that the soft-sided packaging required for cookies, crackers, snack chips, etc. in these machines permits the contents of the package to be crushed or broken, which is undesirable.

Thus, a need remains for improved means for vending non-beverage food items or non-comestible items from vending machines which are widely or prevalently available for dispensing beverages. A need also remains for improved packaging for food or non-food items for vending machines.

SUMMARY OF THE INVENTION

In accordance with the present invention, a container structure suitable for containing non-beverage materials, such as solid or semi-solid foods or non-food items, is sized and shaped to be dispensed from a vending machine sized and configured for dispensing conventional drink cans. Accordingly, food items and non-food items alike may be made readily available to the public from conventional canned (e.g., soft drink) vending machines which are so prevalent.

The container structure comprises a body which is generally shaped as a cylinder and has a first enclosing end and a second enclosing end which define an interior space therebetween. At least one of the ends of the container structure may be openable to access the food or non-food item within the container. The openable end or ends may be detachable from the body and may provide means for removing the end of the container structure to access food or non-food items positioned in the interior space. The openable end or ends may further be structured to be recloseable so that food or non-food items not removed from the container structure, or replaced in the container, may be saved and stored securely therein.

Alternatively to having one or more openable ends, the container may comprise a body which is generally cylindrical, but which comprises two halves which come into registration with each other in some manner which allows separation of the two halves to access the food or non-food items retained within the container. Still alternatively, the body of the container may be configured with some other means of access to the interior thereof, such as a zipper formed along the length of the body.

The container may be made of any suitable material which is relatively indestructible under typical conditions of dispensing through a vending machine and which is suitable for retaining comestibles and non-comestible items therein. For the purpose of this disclosure, the terms "non-food" and "non-comestible" are used interchangeably and refer to any item which is not intended for eating or drinking by humans. Thus, the container structure may be aluminum which has an appropriate coating on the inside surface thereof, or may be hardened plastic, polyfoam material, rubber or the like. The container structure is most suitably sized and shaped in the manner of a conventional twelve ounce soft drink can. However, the container may be sized and shaped for dispensing from a vending machine which is sized and configured to dispense smaller cylinders, such as six ounce juice cans.

The invention further embraces methods for packaging solid or semi-solid food or non-food items for vending machines and for vending such food and non-food items from machines. The method for packaging food or non-food items comprises providing a container sized and shaped to be dispensed by a beverage vending machine configured to vend canned beverages, and sealing a food or non-comestible item within the container. The method for vending food and non-comestible items from machines comprises providing a container sized and shaped to be dispensed by a beverage vending machine configured to vend canned drinks, sealing a food or non-food item within the container, and placing the container containing a food or non-food item in the beverage vending machine.

The present invention provides means for dispensing solid or semi-solid food from vending machines which are sized and configured for dispensing canned drinks and thereby provides the consumer with an expanded food and beverage choice from a single vending machine. The present invention also provides means for dispensing non-comestible items from vending machines configured to dispense canned drinks and thereby provides the consumer with a source of beverages along with particular items in a location where such non-comestible items may not otherwise by available. For example, a first aid kit packaged within a container structure sized to be dispensed from a vending machine which is configured to dispense canned soda would enable first aid items to be readily available to travellers along a stretch of highway where only a canned drink vending machine is available at a rest stop. The present invention also provides packaging for vendable solid food which is more readily recyclable than packaging materials currently used for vendable foods.

BRIEF DESCRIPTION OF THE DRAWINGS

In the drawings, which depict what is presently regarded as the best mode for carrying out the invention.

DETAILED DESCRIPTION OF THE ILLUSTRATED EMBODIMENTS

Figure 1:
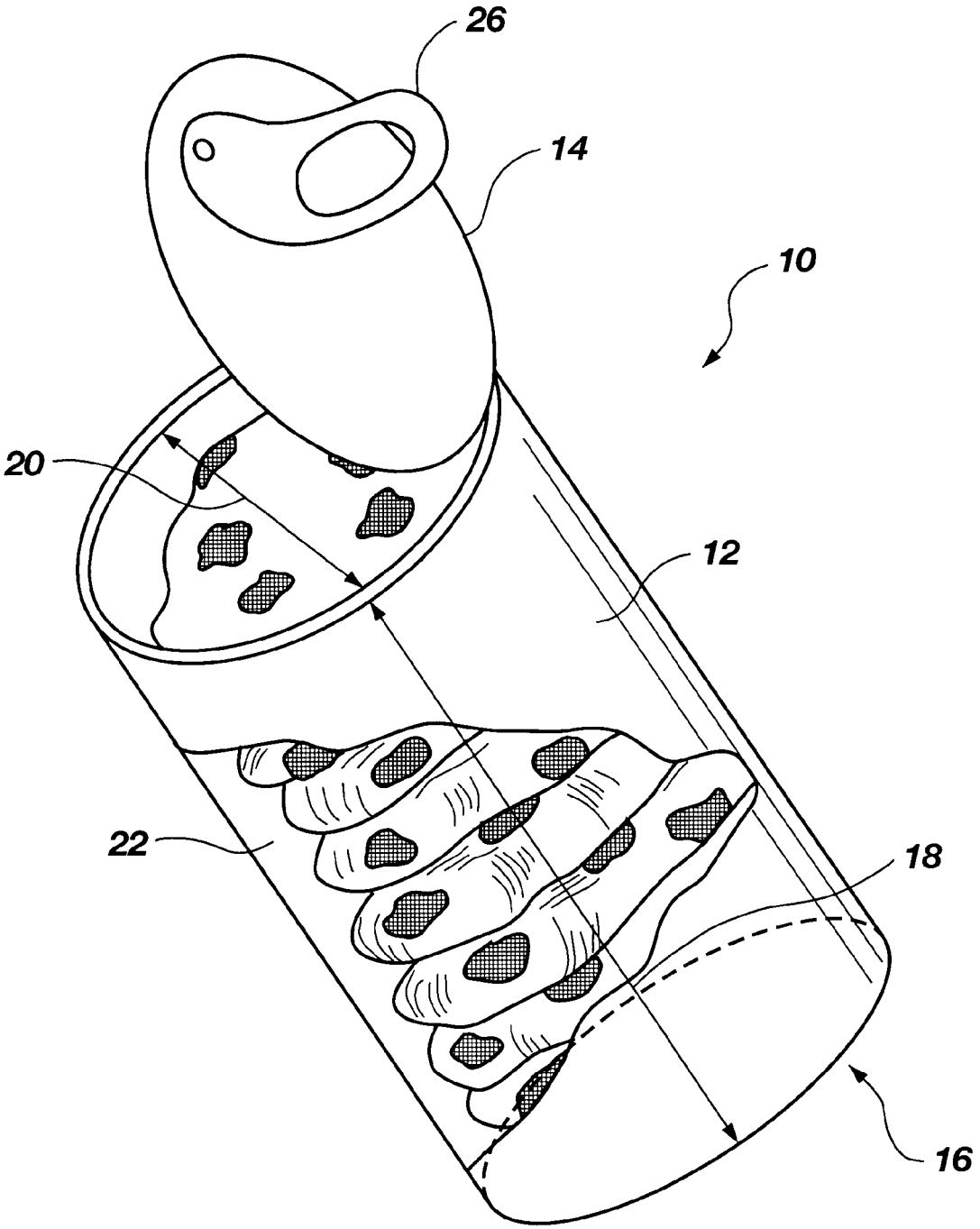
FIG. 1 is a perspective view including a partial cutaway of an embodiment of a vendable food container according to the invention.
Figure 2:
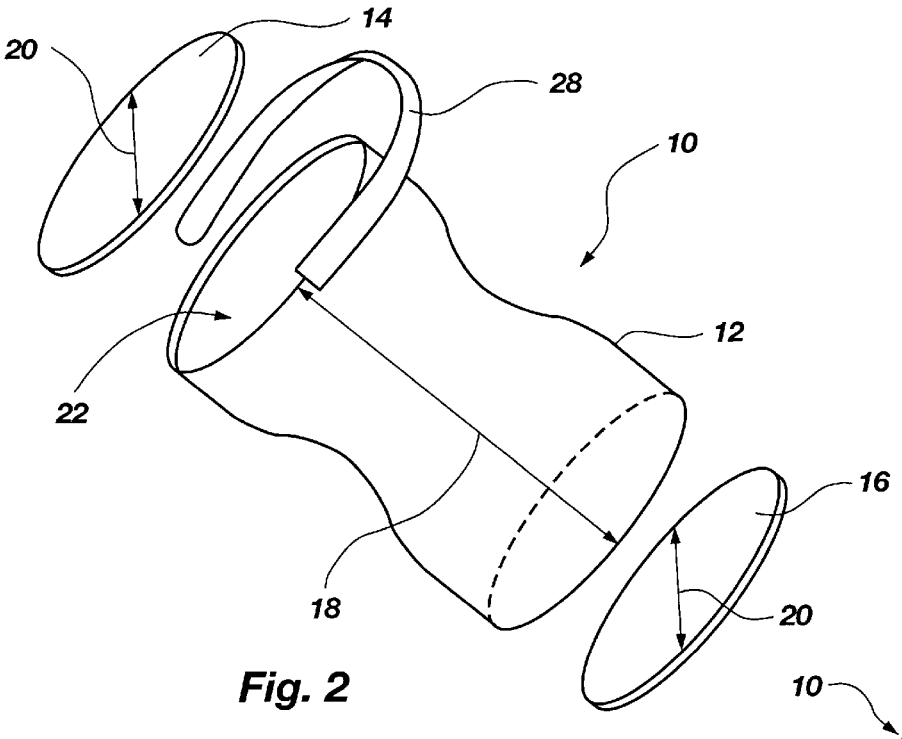
FIG. 2 is a perspective view of an alternative embodiment of the container structure.

The container structure 10 of the present invention is shown in FIG. 1 as having a body 12, a first end 14 and a second end 16. The body 12 of the container structure 10 may be generally cylindrical, as illustrated in FIG. 1, but need not be arcuate. For example, the body 12 may be generally cylindrical, but may comprise multiple facets or sides, such as a dodecagonally-sided structure. Alternatively, the body 12 may be somewhat less than strictly cylindrical, such as an hourglass configuration, as shown in FIG. 2. It is only important that the overall dimension of the container structure 10 be suitable for dispensing through a vending machine which is sized and configured for dispensing canned drinks, which may require that the body 12 be capable of rolling or moving down a chute.

Thus, in the case of a vending machine sized and configured to dispense conventional twelve ounce aluminum soda cans, which currently have the general dimensions of 12 centimeters in height and 4.3 centimeters in diameter, the container structure 10 of the invention may comprise the approximate dimensions of 12 centimeters in height, indicated at 18, and 4.3 centimeters in diameter, indicated at 20. The diameter 20 of the container structure 10 is most typically determined by the ends 14, 16 thereof. Therefore, the first end 14 and second end 16 of the container structure 10 may each have a diameter of approximately 4.3 centimeters, and the distance 18 between the ends 14, 16 may be approximately 12 centimeters, thereby approximating the conventional dimensions of an aluminum soda can. However, the dimensions of the container structure 10 may be less than or greater than the height and diameter of conventional soda cans, as long as the container structure 10 is capable of being dispensed through the mechanism of a conventional canned drink vending machine. Further, the body 12 of the container structure 10 may deviate from a strictly cylindrical configuration, as shown in FIG. 2.

The container structure 10 may comprise any height, diameter or circumference dimension which renders it suitable for dispensing from a vending machine which is sized and configured for dispensing canned drinks. Therefore, alternatively to being similarly sized to a canned soda drink, the container structure 10 may comprise dimensions similar to those of an eight ounce juice can, such as are readily used for canning tropical fruit juices, or dimensions similar to those of a six ounce juice can, such as are readily used for canning V8® juice and the like. Other sizes and configurations of cans containing liquid, and being suitable for dispensing in a vending machine, are available other than those specifically mentioned herein and comprise sizes and dimensions which are suitable for adoption in the configuring and sizing of container structure 10 of the invention.

Figure 3:
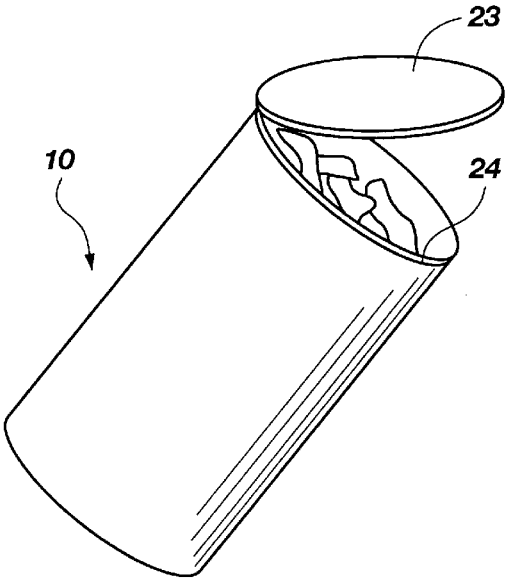
FIG. 3 is a perspective view of an embodiment of the container structure illustrating a recloseable end.

At least one of the ends 14, 16 of the container structure 10 may be structured to be separable, either partially or completely, from the body 12 to permit access to the interior 22 of the container structure 10. Alternatively, both the first end 14 and the second end 16 may be separable from the body 12 to access the interior 22 from either or both ends. The separable end or ends 14, 16 may be completely detachable, as suggested by FIG. 2, or the separable end or ends 14, 16 may be substantially separable, but not fully detachable, as suggested by FIG. 1, so that access can be had to the interior 22 of the container structure 10, but the end remains therewith. Such a configuration may be desirable to limit or prevent littering, or to facilitate recycling of the entire container structure 10 upon disposal. Alternatively, as illustrated by FIG. 3, the end or ends 14, 16 may be recloseable, such as by providing a plastic or plastic-type end 23 which may come into secure registration with the edge 24 of the container structure 10.

Means for removing or otherwise opening the end or ends 14, 16 of the container structure 10 include a pull tab 26 secured to the outer surface of an end 14, as illustrated in FIG. 1. Alternatively, an end 14 may be detachable from the body 12 by pulling a strip 28 of material, such as plastic, which seals the end 14 to the body 12, as illustrated in FIG. 2. Alternatively, the end or ends may be configured with circumferential thread means so that the end or ends may be screwed into an open end of the body 12, the body having reciprocating thread means. Other methods of removal of the end or ends 14, 16 from the body are known in the art and may be suitably employed.

Figure 4:
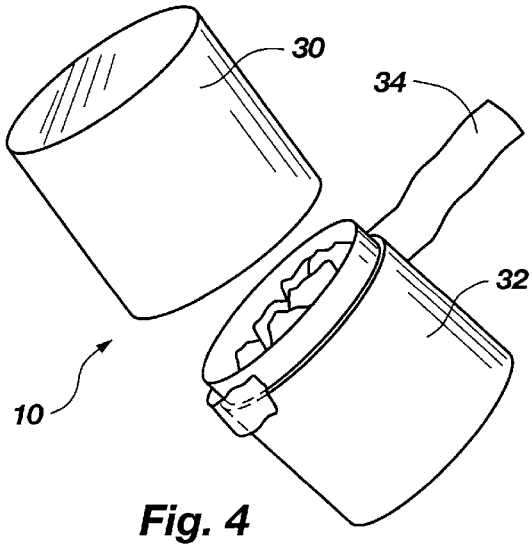
FIG. 4 is another alternative embodiment of the container structure.

Still alternatively, as illustrated in FIG. 4, the container structure 10 may be configured as two halves 30, 32 which are in slidable registration with each other. The two halves 30, 32 may be secured together by, for example, a circumferential tab 34 which encircles and joins the two halves 30, 32 together. When access to the interior of the container structure 10 is desired, the circumferential tab 34 may be peeled from about the container structure 10 and the two halves 30, 32 may be twisted apart. Alternatively, the two halves 30, 32 may be configured with reciprocating thread means facilitating the joining or separation of the two halves by screwing them together or apart.

The container structure 10 may be made of any material which is suitable for enclosing food materials and which is capable of withstanding the impacts to which canned foods and drinks are typically subjected during dispensing from a vending machine. Such materials may include aluminum, tin, steel, alloys of those or other metals, or the like. When metals or metal alloys are used, a comestible coating (that is, one which protects the food from the metallic surface, but which does not taint the food or cause an adverse reaction to the person consuming the food) may be suitable for lining the interior 22 of the container structure 10. Alternatively, the container structure 10 may be made of plastic, sturdy polymeric materials or heavy cardboard.

Figure 5:
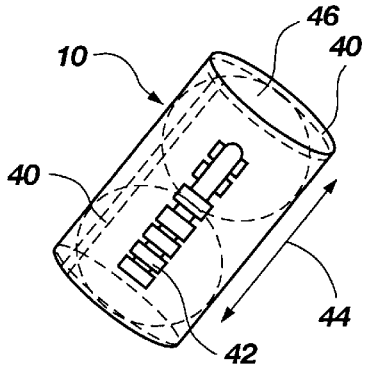
FIG. 5 is another alternative embodiment of the container structure.

The container structure 10 is equally suited for retaining non-food or non-comestible items therein, and may be configured in the manner heretofore described. When the container structure 10 is used to retain non-food items, however, additional configurations or materials of construction may be used which accommodate the particular characteristics of the item being retained, but which still render the container structure 10 suitable for being dispensed from a vending machine sized to vend canned drinks. For example, as illustrated by FIG. 5, the body 12 of the container structure 10 may be made of softer material, such as nylon (which may be suitably reinforced along the circumference and/or length of the body 12 as suggested in phantom at 40), and may have a zipper 42 positioned along the length 44 of the body 12 for retrieving an item, such as tennis balls 46, from within the container structure 10.

The container structure 10 of the present invention is structured to retain solid or semi-solid food or non-food items therein. Foods which would be appropriate for retention in the container structure 10 are those snack foods which are typically available from vending machines, and include cookies, cakes, snack chips, crackers, nuts, candy and chocolates. Other food materials which may be retained in the container structure 10 include dried fruit (e.g., raisins, banana chips, fruit leather), cereal products such as granola or trail mix, beef jerky, and fresh vegetables such as carrot sticks. Semi-solid foods, such as yogurt, puddings, custards, ice creams, and the like, may also be contained therein. The container structure 10 may be structured to be freezable, refrigeratable or maintained at room temperature. The container structure 10 may even be structured to be heatable, if appropriate.

Examples of non-comestible items which may be retained in the container structure include first aid items in a kit form; sporting goods products such as golf balls, tennis balls, fishing line, lures or bait; clothing items such as hosiery, gloves, caps or the like; toys for children; cleaning items such as detergents or fabric softeners; personal hygiene products such as shaving items, shampoo or feminine products; or pet food.

The container structure 10 of the present invention provides an advantage in the art of vending comestible and non-comestible products since it permits vending solid or semi-solid food or non-food from vending machines which are structured for dispensing canned drinks. Thus, a vendor may use a single type of machine to provide to the public both beverages, food and non-food products. The consumer is also benefitted by being able to purchase beverages, food and non-food items from the same vending machine. This may be particularly advantageous to travelers who need a particular item while travelling along the highways or byways, and all that is available is a vending machine at a rest stop.

Providing a container structure which is sized and configured in a manner similar to a drink can also facilitates restocking of vending machines since cans are more readily loaded into a vending machine in comparison to individual packages of different size and shape. Additionally, packaging food and non-food items in container structures which are similar in construction to aluminum beverage cans facilitates recycling of the container and reduces the accumulation of plastic wrappers which are not readily recyclable.

The present invention may be modified to meet the demands of the particular vending application. Hence, reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. A method of vending non-beverage foods and non-comestible items from a vending machine configured to vend canned drinks comprising the steps of:

providing at least one container sized in dimension and configured to contain a liquid beverage and to be dispensed from a vending machine configured to vend canned drinks, said at least one container being filled with a material other than a liquid beverage;

providing a vending machine configured to vend canned drinks and having signal means for providing selective vending therefrom of containers containing a liquid beverage and containers containing other than a liquid beverage, said vending machine being loaded with said at least one container containing a material other than a liquid beverage orienting said at least one container within said vending machine for selective dispensing with vendable canned drinks; and vending selectively from said vending machine said at least one container containing other than a liquid beverage responsive to a signal selected to vend said at least one container.

2. The method of claim 1 wherein said container is generally cylindrical in shape and has a first end and a second end defining an interior space therebetween, at least one of said ends being separable from said container to provide access to said material sealed within said interior space.

3. The method of claim 2 wherein said container is sized in dimension and is configured substantially similarly to a twelve ounce aluminum can sized and dimensioned for containing a carbonated soft drink.

4. The method of claim 3 wherein said material in said container is a non-liquid comestible.

5. The method of claim 3 wherein said material in said container is a non-comestible.

6. The method of claim 1 further comprising loading said vending machine to solely provide for the dispensing of said at least one container containing a material other than a liquid beverage.

7. The method of claim 1 further comprising loading said vending machine to provide for the dispensing of both canned beverages and said at least one container containing other than a liquid beverage.

* * * * *